US008438856B2

(12) United States Patent
Chila et al.

(10) Patent No.: US 8,438,856 B2
(45) Date of Patent: May 14, 2013

(54) EFFUSION COOLED ONE-PIECE CAN COMBUSTOR

(75) Inventors: Ronald James Chila, Greer, SC (US); Kevin Weston McMahan, Greer, SC (US)

(73) Assignee: General Electric Company, Schenectady, NY (US)

( * ) Notice: Subject to any disclaimer, the term of this patent is extended or adjusted under 35 U.S.C. 154(b) by 613 days.

(21) Appl. No.: 12/395,739

(22) Filed: Mar. 2, 2009

(65) Prior Publication Data

US 2010/0218502 A1 Sep. 2, 2010

(51) Int. Cl.
*F02C 1/00* (2006.01)
*F02G 3/00* (2006.01)

(52) U.S. Cl.
USPC ..... 60/752; 60/754; 60/758; 60/760

(58) Field of Classification Search ..... 60/752–760
See application file for complete search history.

(56) References Cited

U.S. PATENT DOCUMENTS

| | | | | |
|---|---|---|---|---|
| 788,615 | A | 5/1905 | Wellek | |
| 3,990,837 | A | 11/1976 | Snell | |
| 4,292,810 | A | 10/1981 | Glenn | |
| 4,315,406 | A | 2/1982 | Bhangu et al. | |
| 4,695,247 | A * | 9/1987 | Enzaki et al. | 431/352 |
| 4,896,510 | A * | 1/1990 | Foltz | 60/757 |
| 5,758,504 | A | 6/1998 | Abreu | |
| 5,960,632 | A | 10/1999 | Abuaf et al. | |
| 6,237,344 | B1 | 5/2001 | Lee | |
| 6,282,905 | B1 | 9/2001 | Sato et al. | |
| 6,408,628 | B1 | 6/2002 | Pidcock et al. | |
| 6,427,446 | B1 | 8/2002 | Kraft et al. | |
| 6,484,505 | B1 | 11/2002 | Brown et al. | |
| 6,546,731 | B2 | 4/2003 | Alkabie | |
| 6,568,187 | B1 | 5/2003 | Jorgensen | |
| 6,606,861 | B2 | 8/2003 | Snyder | |
| 6,640,547 | B2 | 11/2003 | Leahy | |
| 6,681,578 | B1 | 1/2004 | Bunker | |
| 6,708,499 | B2 | 3/2004 | Pidcock et al. | |
| 6,761,031 | B2 | 7/2004 | Bunker | |
| 6,964,170 | B2 | 11/2005 | Alkabie | |
| 7,036,316 | B2 | 5/2006 | Howell | |
| 7,082,766 | B1 | 8/2006 | Widener et al. | |
| 7,146,815 | B2 | 12/2006 | Burd | |
| 7,219,498 | B2 | 5/2007 | Hadder | |
| 7,303,372 | B2 | 12/2007 | West et al. | |
| 7,310,938 | B2 | 12/2007 | Marcum et al. | |
| 7,373,778 | B2 * | 5/2008 | Bunker et al. | 60/752 |
| 7,874,159 | B2 | 1/2011 | Gerendás et al. | |
| 2006/0272335 | A1 * | 12/2006 | Schumacher et al. | 60/804 |
| 2007/0271925 | A1 * | 11/2007 | Alkabie et al. | 60/772 |
| 2008/0264065 | A1 | 10/2008 | Gerendas | |
| 2009/0120096 | A1 | 5/2009 | Tuthill | |

(Continued)

*Primary Examiner* — Phutthiwat Wongwian
*Assistant Examiner* — Craig Kim
(74) *Attorney, Agent, or Firm* — Cooper Legal Group, LLC

(57) ABSTRACT

A combustor for an industrial turbine includes a single transition piece transitioning directly from a combustor head-end to a turbine inlet. The transition piece includes an inner surface and an outer surface. The inner surface bounds an interior space for combusted gas flow from the combustor head-end to the turbine inlet. The outer surface at least partially defines an area for compressor discharge air flow. The transition piece includes a plurality of apertures configured to allow compressor discharge air flow into the interior space. Each of the plurality of apertures extends from an entry portion on the outer surface to an exit portion on the inner surface.

13 Claims, 2 Drawing Sheets

U.S. PATENT DOCUMENTS

2010/0122537 A1 5/2010 Yankowich et al.
2010/0170257 A1 7/2010 Chila et al.
2010/0177764 A1 7/2010 Witzel et al.
2010/0257863 A1 10/2010 Chila et al.

* cited by examiner

EFFUSION COOLED ONE-PIECE CAN COMBUSTOR

FIELD OF THE INVENTION

The present invention relates generally to means of cooling components of a gas turbine, and more particularly, to effusion cooling of a one-piece can combustor.

BACKGROUND OF THE INVENTION

A gas turbine can operate with great efficiency if the turbine inlet temperature can be raised to a maximum. However, the combustion chamber, from which combusted gas originates before entering the turbine inlet, reaches operating temperatures well over 1500° F. and even most advanced alloys cannot withstand such temperatures for extended periods of use. Thus, the performance and longevity of a turbine is highly dependent on the degree of cooling that can be provided to the turbine components which are exposed to extreme heating conditions.

The general concept of using compressor discharge air to cool turbine components is known in the art. However, developments and variations in turbine designs are not necessarily accompanied by specific structures that are implemented with cooling mechanisms for the turbine components. Thus, there is a need to embody cooling mechanisms into newly developed turbine designs.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

To achieve the foregoing and other aspects and in accordance with the present invention, a can combustor for an industrial turbine is provided which includes a single transition piece transitioning directly from a combustor head-end to a turbine inlet. The transition piece defines an exterior space for compressor discharge air flow and an interior space for combusted gas flow. The transition piece includes an outer surface bounding the exterior space and an inner surface bounding the interior space. The transition piece includes a plurality of apertures configured to allow compressor discharge air flow into the interior space. Each of the plurality of apertures extends from an entry portion on the outer surface to an exit portion on the inner surface.

In accordance with another aspect of the present invention, an industrial turbine engine includes a combustion section, an air discharge section downstream of the combustion section, a transition region between the combustion and air discharge section, and a combustor transition piece. The combustor transition piece defines the combustion section and transition region. The transition piece is adapted to carry combusted gas flow to a first stage of the turbine corresponding to the air discharge section, and defines an exterior space for compressor discharge air flow and an interior space for combusted gas flow. The transition piece includes an outer surface bounding the exterior space and an inner surface bounding the interior space, and includes a plurality of apertures configured to allow compressor discharge air flow into the interior space. Each of the plurality of apertures extends from an entry portion on the outer surface to an exit portion on the inner surface.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
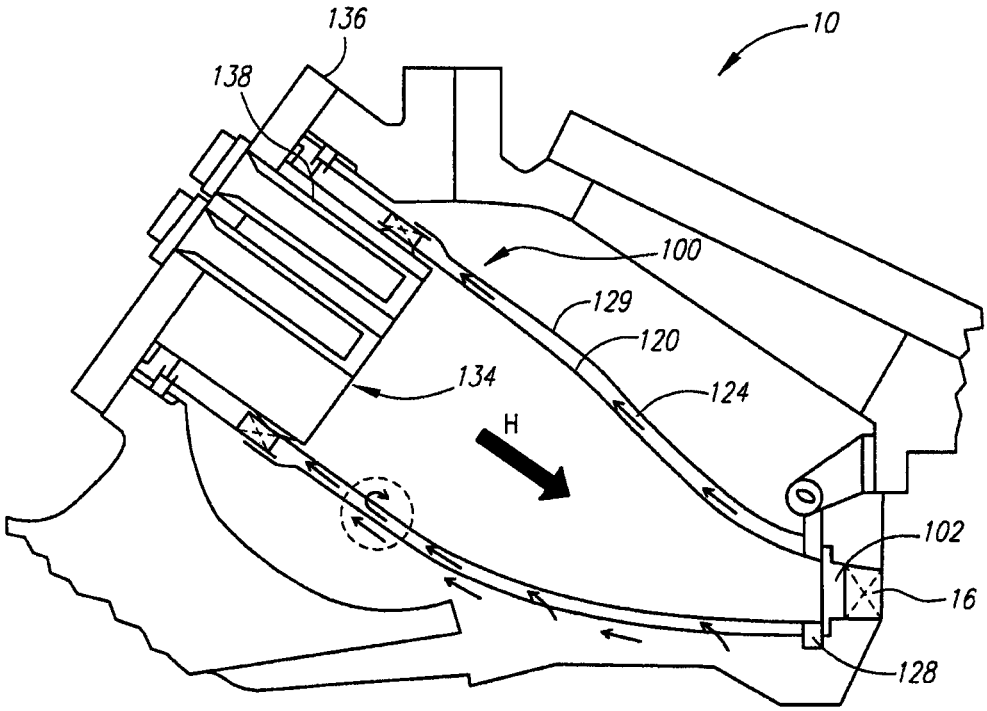
FIG. 1 is a schematic cross-section of an example embodiment of a one-piece can combustor in which the present invention can be implemented.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

FIG. 1 shows an embodiment of a single piece combustor 10 in which the present invention can be implemented. This shown example embodiment is a can-annular reverse-flow combustor 10 although the invention is applicable to other types of combustors. The combustor 10 generates gases needed to drive the rotary motion of a turbine by combusting air and fuel within a confined space and discharging the resulting combustion gases through a stationary row of vanes. In operation, discharge air from a compressor reverses direction as it passes over the outside of the combustors 10 and again enters the combustor 10 en route to the turbine. Compressed air and fuel are burned in the combustion chamber. The combustion gases flow at high velocity into a turbine section via a transition piece 120. As discharge air flows over the outside surface of the transition piece 120, it provides convective cooling to the combustor components.

In FIG. 1, a transition piece 120 transitions directly from a circular combustor head-end 100 to a turbine annulus sector 102 (corresponding to the first stage of the turbine indicated at 16) with a single piece. The single-piece transition piece 120 may be formed from two halves or several components welded or joined together for ease of assembly or manufacture. A sleeve 129 also transitions directly from the circular combustor head-end 100 to an aft frame 128 of the transition piece 120 with a single piece. The single piece sleeve 129 may be formed from two halves and welded or joined together for ease of assembly. The joint between the sleeve 129 and the aft frame 128 forms a substantially closed end to a cooling annulus 124. It should be noted that "single" also means multiple pieces joined together wherein the joining is by any appropriate means to join elements, and/or unitary, and/or one-piece, and the like.

In FIG. 1, there is an annular flow of the discharge air that is convectively processed over the outside surface of the transition piece 120. In the example embodiment, the discharge air flows through the sleeve 129 which forms an annular gap so that the flow velocities can be sufficiently high to produce high heat transfer coefficients. The sleeve 129 surrounds the transition piece 120 forming a flow annulus 124 therebetween. Cross flow cooling air traveling in the annulus 124 continues to flow upstream as indicated by arrows. In an alternative embodiment, the sleeve 129 may not extend completely from the combustor head-end 100 to the aft frame 128. A circled area of the transition piece 120 will be discussed in more detail in FIGS. 2-3.

In conventional combustors, a combustor liner and a flow sleeve are generally found upstream of the transition piece and the sleeve respectively. However, in the one-piece can combustor of FIG. 1, the combustor line and the flow sleeve have been eliminated in order to provide a combustor of shorter length. The major components in a one-piece can combustor include a circular cap 134, an end cover 136 supporting a plurality of fuel nozzles 138, the transition piece 120 and sleeve 129 and are known in the art. For example, a more detailed description of a one-piece can combustor can be found in U.S. Pat. No. 7,082,766 to Widener et al.

Figure 2:
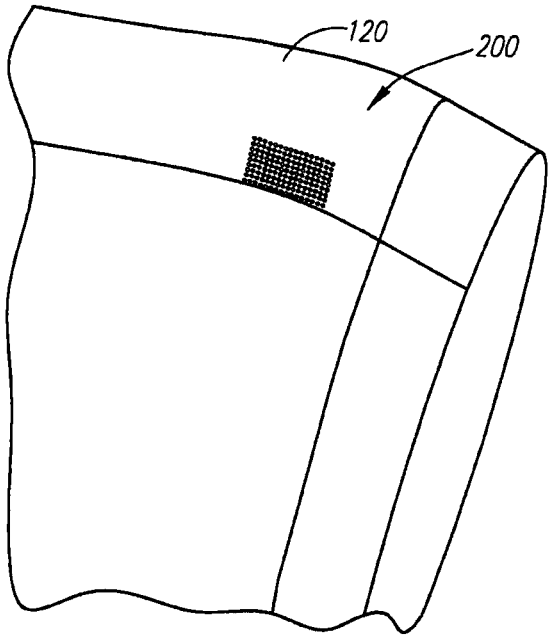
FIG. 2 shows a close-up perspective view of a transition piece with effusion holes.

FIG. 2 shows, in an isolated state, an embodiment of the single piece transition piece 120 formed with a plurality of apertures or effusion holes 200. It must be noted that FIG. 2 shows one example arrangement of apertures 200 near the combustor head-end 100 for simplicity of illustration only and this example arrangement must not be construed as a limitation of the invention. Thus, formation of the apertures 200 may be at or extend to other selected areas or over the entire outer surface of the transition piece 120. The selected areas where apertures 200 are formed may be spots on the transition piece 120 that tend to become relatively hotter than other areas during operation of the turbine and thus could benefit from further cooling. Alternatively, the apertures 200 may be formed in a circumferentially dispersed manner or may extend from an upstream portion to a downstream portion of the transition piece 120. Moreover, FIG. 2 shows only one of multiple possible arrangements in which the plurality of apertures 200 can be patterned. For example, the apertures 200 may be orthogonally located about one another. In another example, each aperture 200 in a row may be slightly offset relative to apertures in an adjacent row. Such variety in arrangement is within the scope of the present invention.

Figure 3:
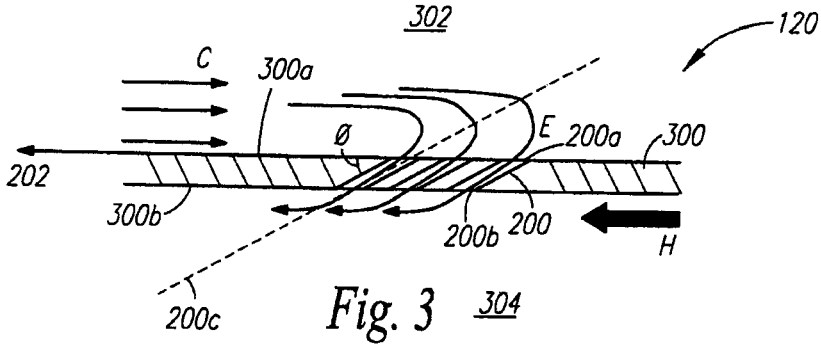
FIG. 3 shows a cross-sectional view across the effusion holes of the transition piece.

FIG. 3 shows a cross-section through the apertures 200 formed through a wall 300 that is part of the transition piece 120. Again, a limited number of apertures 200 are shown on the transition piece 120 for simplicity of illustration. FIG. 3 shows an outer surface 300*a* and an inner surface 300*b* of the wall 300. The area above the wall is the exterior space 302 of the transition piece 120 while the area below the wall is the interior space 304 of the transition piece 120. As stated above, depending on the embodiment or the part of the transition piece 120, the sleeve 129 may or may not be present adjacent the transition piece 120 and thus the flow annulus 124 may or may not be formed in this area. If the sleeve 129 is present, the sleeve 129 will be part of the exterior space 302 and the flow annulus 124 will be formed between the sleeve 129 and the transition piece 120.

A right side of FIG. 3 corresponds to an upstream area of the turbine while a left side of FIG. 3 corresponds to a downstream area of the turbine. Thus, flow H, made up of hot gas, originates from the combustion chamber and is directed downstream in the interior space 304 of the transition piece 120. Flow C, made up of compression discharge air which is cooler than combusted hot gas, originates from the compressor but approaches the transition piece 120 from a downstream area of the turbine and moves upstream on the exterior space 302 of the transition piece 120 as is typical in a can-annular, reverse-flow combustor.

The apertures 200 extend from the outer surface 300*a* to the inner surface 300*b* of the wall 300. The invention encompasses apertures 200 formed to be normal to the wall 300 and apertures 200 formed at an angle θ to the wall 300. In FIG. 3, the apertures 200 are shown at the angle θ such that exit portions 200*b* of the apertures 200 are downstream or rearward relative to entry portions 200*a* of the apertures 200. In one embodiment, the angle θ is formed by the longitudinal axes 200*c* of the apertures 200 and a direction 202 that is tangential to the wall 300 and is pointed downstream. The angle θ may be acute at 30 degrees and may range from 20 to 35 degrees. However, other smaller and larger angles are also contemplated. In FIG. 3, the downstream tangent points to the left. Although the second apertures 200 are substantially cylindrical, the entry portions 200*a* and the exit portions 200*b* will have elliptical shapes if the apertures 200 are not normal to the wall 300. However, the apertures 200, 400 may have a cross section that is not circular and, for example, is polygonal.

Another variation of the apertures 200 is that the angular position of the entry portion 200*a* may be different from the angular position of the exit portion 200*b* on the circumference of the transition piece 120. Moreover, the exit portion 200*b* of the apertures 200 may be upstream or forward relative to the entry portion 200*a* of the apertures 200 thereby creating an obtuse angle between the longitudinal axes of the apertures 200 and the direction 202.

In FIG. 3, the apertures 200 have a substantially cylindrical geometry with a constant diameter from the entry portion to the exit portion. In one embodiment, the diameter may be 0.03 inch and alternatively may range from 0.02 inch to 0.04 inch. Of course, other dimensions for the apertures 200 are also contemplated. For example, the apertures 200 may gradually increase or decrease in diameter through the wall 300.

The apertures 200 may be formed through the wall 300 of the transition piece 120 by laser drilling or other machining methods selected based on factors such as cost and precision.

In FIG. 3, flow C provides convective cooling of the transition piece 120 by removing heat while passing over the outer surface 300*a*. Flow E created by the apertures or effusion holes 200 provide jets of air at all or selected areas of the transition piece 120 that cool the transition piece 120 as the cooling air passes through the apertures 200 contacting internal surfaces therein. Effusion cooling is a form of transpiration cooling. An aperture that is other than perpendicular to the wall 300 will have a larger internal surface area compared to an aperture normal to the wall due to increased length so that heat transfer is prolonged and greater cooling of the transition piece 120 can be achieved. Moreover, after the cool air exits the exit portion 200*b* of the apertures 200, a layer or film of cooling air is formed adjacent the inner surface 300*b* of the wall 300 of the transition piece 120. Formation of such a layer of cooling air on the inner surface 300*b* further cools the transition piece 120. The formation of such a layer is facilitated by an angled aperture compared to a normal aperture since the degree of change required in direction by the cool air is reduced. However, the present invention encompasses the two variations of normal and angled apertures. Cooling by the film formed on the inner surface can improve as the hole sizes and angles are decreased. However, smaller holes are more prone to blockage from impurities. In comparison, larger holes can cause excessive penetration of the hot gas stream by the cool air jets and reduce the efficiency of the turbine. Therefore, such benefits and drawbacks must be collectively considered when determining the geometry of the effusion holes.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A combustor for an industrial turbine including:

a single transition piece transitioning directly from a combustor head-end to a turbine inlet and configured to direct combusted gas flow in a stream from the combustor head to the turbine inlet without reversal of direction of the transition piece, the transition piece including an inner surface and an outer surface, the inner surface bounding an interior space for the combusted gas flow from the combustor head-end to the turbine inlet, the outer surface at least partially defining an area for compressor discharge air flow, the transition piece including a plurality of apertures configured to allow compressor discharge air flow, approaching the transition piece from a relatively downstream area of the turbine with respect to the combusted gas flow, into the interior space, each of the plurality of apertures extending from an entry portion on the outer surface to an exit portion on the inner surface, with the exit portion of each aperture being located further downstream, with respect to the combusted gas flow, than the respective entry portion to cause a reversal of direction of the compressor discharge air as the compressor discharge air proceeds into the interior space.

2. The combustor of claim 1, wherein longitudinal axes through the apertures are oriented to form an acute angle with a downstream tangent to the outer surface.

3. The combustor of claim 2, wherein the acute angle ranges from 20° to 35°.

4. The combustor of claim 1, wherein the plurality of apertures have a constant diameter from the entry portion to the exit portion ranging from 0.02 inch to 0.04 inch.

5. The combustor of claim 1, wherein the apertures are substantially normal to the outer surface.

6. The combustor of claim 1, wherein the transition piece is jointless.

7. An industrial turbine engine including:

a combustion section;

an air discharge section downstream of the combustion section;

a transition region directly between the combustion and air discharge section; and a combustor transition piece defining the combustion section and transition region, the transition piece adapted to carry combusted gas flow to a first stage of the turbine corresponding to the air discharge section without reversal of direction of the transition piece, the transition piece including an inner surface and an outer surface, the inner surface bounding an interior space for combusted gas flow from the combustor head-end to the turbine inlet, the outer surface at least partially defining an area for compressor discharge air flow, the transition piece including a plurality of apertures configured to allow compressor discharge air flow, approaching the transition piece from a relatively downstream area of the turbine with respect to the combusted gas flow, into the interior space, each of the plurality of apertures extending from an entry portion on the outer surface to an exit portion on the inner surface, with the exit portion of each aperture being located further downstream, with respect to the combusted gas flow, than the respective entry portion to cause a reversal of direction of the compressor discharge air as the compressor discharge air proceeds into the interior space.

8. The industrial turbine engine of claim 7, wherein longitudinal axes through the apertures are oriented to form an acute angle with a downstream tangent to the outer surface.

9. The industrial turbine engine of claim 8, wherein the acute angle ranges from 20° to 35°.

10. The industrial turbine engine of claim 7, wherein the plurality of apertures have a constant diameter from the entry portion to the exit portion ranging from 0.02 inch to 0.04 inch.

11. The industrial turbine engine of claim 7, wherein the apertures are substantially normal to the outer surface.

12. A combustor for an industrial turbine including:

a single transition piece transitioning directly from a combustor head-end to a turbine inlet and configured to direct combusted gas flow in a stream from the combustor head to the turbine inlet without reversal of direction of the transition piece, the transition piece including an inner surface and an outer surface, the inner surface bounding an interior space for the combusted gas flow from the combustor head-end to the turbine inlet, the outer surface at least partially defining an area for compressor discharge air flow, the transition piece including a plurality of apertures configured to allow compressor discharge air flow, approaching the transition piece from a relatively downstream area of the turbine with respect to the combusted gas flow, into the interior space, each of the plurality of apertures extending from an entry portion on the outer surface to an exit portion on the inner surface, with the exit portion of each aperture being located further downstream, with respect to the combusted gas flow, than the respective entry portion to cause a reversal of direction of the compressor discharge air as the compressor discharge air proceeds into the interior space, wherein the combustor is a can-annular, reverse-flow type such that combusted gas flow and compressor discharge air flow are configured to be in opposing directions such that longitudinal axes through the apertures form an acute angle with a direction of combusted gas flow and an obtuse angle with a direction of compressor discharge air flow.

13. An industrial turbine engine including:

a combustion section;

an air discharge section downstream of the combustion section;

a transition region directly between the combustion and air discharge section; and a combustor transition piece defining the combustion section and transition region, the transition piece adapted to carry combusted gas flow to a first stage of the turbine corresponding to the air discharge section without reversal of direction of the transition piece, the transition piece including an inner surface and an outer surface, the inner surface bounding an interior space for combusted gas flow from the combustor head-end to the turbine inlet, the outer surface at least partially defining an area for compressor discharge air flow, the transition piece including a plurality of apertures configured to allow compressor discharge air flow, approaching the transition piece from a relatively downstream area of the turbine with respect to the combusted gas flow, into the interior space, each of the plurality of apertures extending from an entry portion on the outer surface to an exit portion on the inner surface, with the exit portion of each aperture being located further downstream, with respect to the combusted gas flow, than the respective entry portion to cause a reversal of direction of the compressor discharge air as the compressor discharge air proceeds into the interior space, wherein the combustor transition piece is a can-annular, reverse-flow type such that combusted gas flow and compressor discharge air flow are configured to be in opposing directions such that longitudinal axes through the apertures form an acute angle with a direction of combusted gas flow and an obtuse angle with a direction of compressor discharge air flow.

* * * * *